US006951068B1

(12) United States Patent
Weatherill

(10) Patent No.: US 6,951,068 B1
(45) Date of Patent: Oct. 4, 2005

(54) METHOD AND APPARATUS FOR DISPLAYING WORKS OF ART

(75) Inventor: Sean B. Weatherill, Castro Valley, CA (US)

(73) Assignee: Pikture Klips LLC, Oakland, CA (US)

( * ) Notice: Subject to any disclaimer, the term of this patent is extended or adjusted under 35 U.S.C. 154(b) by 0 days.

(21) Appl. No.: 09/823,816

(22) Filed: Mar. 30, 2001

Related U.S. Application Data

(60) Provisional application No. 60/195,632, filed on Apr. 7, 2000.

(51) Int. Cl.[7] ..... G09F 1/12

(52) U.S. Cl. ..... 40/729; 40/730; 40/605; 40/733; 40/658

(58) Field of Search ..... 40/658, 790, 792, 40/617, 605, 729–733; 24/67.11; 211/45, 211/89.01; 403/384, 385, 388, 389

(56) References Cited

U.S. PATENT DOCUMENTS

| | | | | | |
|---|---|---|---|---|---|
| 905,951 | A | * | 12/1908 | Sturla | 40/658 |
| 1,313,778 | A | * | 8/1919 | Atkinson | 40/658 |
| 2,885,166 | A | * | 5/1959 | Lehni et al. | 40/658 |
| 3,981,091 | A | * | 9/1976 | Wiener, Jr. | 40/792 |
| 4,010,517 | A | * | 3/1977 | Kapstad | 24/67.11 |
| 4,827,639 | A | * | 5/1989 | Wang | 40/730 |

* cited by examiner

*Primary Examiner*—Cassandra Davis
(74) *Attorney, Agent, or Firm*—Knobbe Martens Olson & Bear LLP

(57) ABSTRACT

A method and apparatus for displaying works of art is disclosed. In one embodiment, a display unit is used to display artwork. The display unit is comprised of at least one overlay section set having at least two overlay sections. It also has at least one clip for securing said overlay sections together. The display unit has at least one securing platform to support said overlay section set.

14 Claims, 4 Drawing Sheets

METHOD AND APPARATUS FOR DISPLAYING WORKS OF ART

This application claims the benefit of the filing date of the following Provisional U.S. Patent Application: "METHOD AND APPARATUS FOR DISPLAYING WORKS OF ART", application No. 60/195,632, filed Apr. 7, 2000.

FIELD OF THE INVENTION

The present invention relates to a manner of displaying art. In particular, the invention focuses on artistic or other displays which are suitable for framing. The invention addresses displays which are intended to be of individual or collage form.

BACKGROUND OF THE INVENTION

Several forms of art and methods of displaying artwork involve the utilization of frames or frame units which are designed to display multiple pieces of art simultaneously. Often these multiple displays involve the display of photographs or pictures.

An example of this method of displaying artwork is exhibited by the collage frame. A collage frame is a frame with a backing section, a transparent section, and a frame perimeter. The frame is marked by a large perimeter as with other non-collage frames. However, the collage frame also has several intersecting linear portions which extend interior of the large perimeter and visually divide the underlying transparent section into several sections. In the alternative, a subdivided matting may be disposed under the transparent section in order to give the appearance of a divided transparent section. Photographs or other pieces of art may then be disposed between the apparent subdivided transparent section (or the matting, as the case may be) and the backing section. That is, each subdivided transparent section will reveal a separate photograph or other piece of art.

A second example of this method of displaying artwork is exhibited by the linking of multiple transparent sections by a single linked frame unit. This linked frame unit generally involves the use of several individual frame perimeters, each having a corresponding backing section, and a corresponding transparent section. Again, a photo or other piece of art will be disposed between the transparent section and the backing section. However, no matting is required and no linear portions will extend interior of the frame perimeters. Rather, several frame perimeters will be linked to one another in the form of a single linked frame unit. This single linked frame unit displays several pieces of art simultaneously as did the collage frame.

In the case of the collage frame, and the linked frame unit, the number and outlay of the photos (or pieces of art) are predetermined. That is, in the case of the collage frame, the linear portions which extend interior of the frame perimeter, or the matting, will be determinative of the number and precise outlay of photos which may be displayed. In the case of the frame unit, the number and outlay of frame perimeters and corresponding backing and transparent sections are determinative of the number and outlay of the photos to be displayed. Unless the user decides to leave certain areas of the display blank, he or she is limited in photo outlay and number as predetermined by the design of the collage frame or the frame unit.

While the simultaneous display of multiple pieces of art is often desirable, the pieces of art to be displayed simultaneously are subject to a wide variety of subjective user tastes. The user may have a precise number of pieces of art which he or she feels would belong in the same display unit (i.e. collage frame or linked frame unit). In fact, the user may wish to display a single piece of art in certain situations while later deciding to display multiple pieces of art. Therefore, what is desired is a method of displaying one or more pieces of art simultaneously and in a manner which may be user determined with respect to the number of pieces of art displayed. It is also desired that an apparatus be provided which would allow the outlay of the pieces of art to be user determined.

SUMMARY OF THE INVENTION

A method and apparatus for displaying works of art is disclosed. In one embodiment, a display unit is used to display artwork. The display unit is comprised of at least one overlay section set having at least two overlay sections. It also has at least one clip for securing said overlay sections together. The display unit has at least one securing platform to support said overlay section set.

BRIEF DESCRIPTION OF THE DRAWINGS

The accompanying drawings, which are included as part of the present specification, illustrate the presently preferred embodiment of the present invention and together with the general description given above and the detailed description of the preferred embodiment given below serve to explain and teach the principles of the present invention.

DETAILED DESCRIPTION

The present invention provides a method and apparatus for creating a display unit of individual or collage form. In one embodiment, a display unit is used to display artwork. The display unit is comprised of at least one overlay section set having at least two overlay sections. It also has at least one clip for securing said overlay sections together. The display unit has at least one securing platform to support said overlay section set.

The following description makes reference to numerous specific details in order to provide a thorough understanding of the present invention. However, each specific detail need not be employed to practice the present invention. Additionally, well known details, such as particular materials or methods, have not been described in order to avoid unnecessarily obscuring the present invention.

Figure 1A:
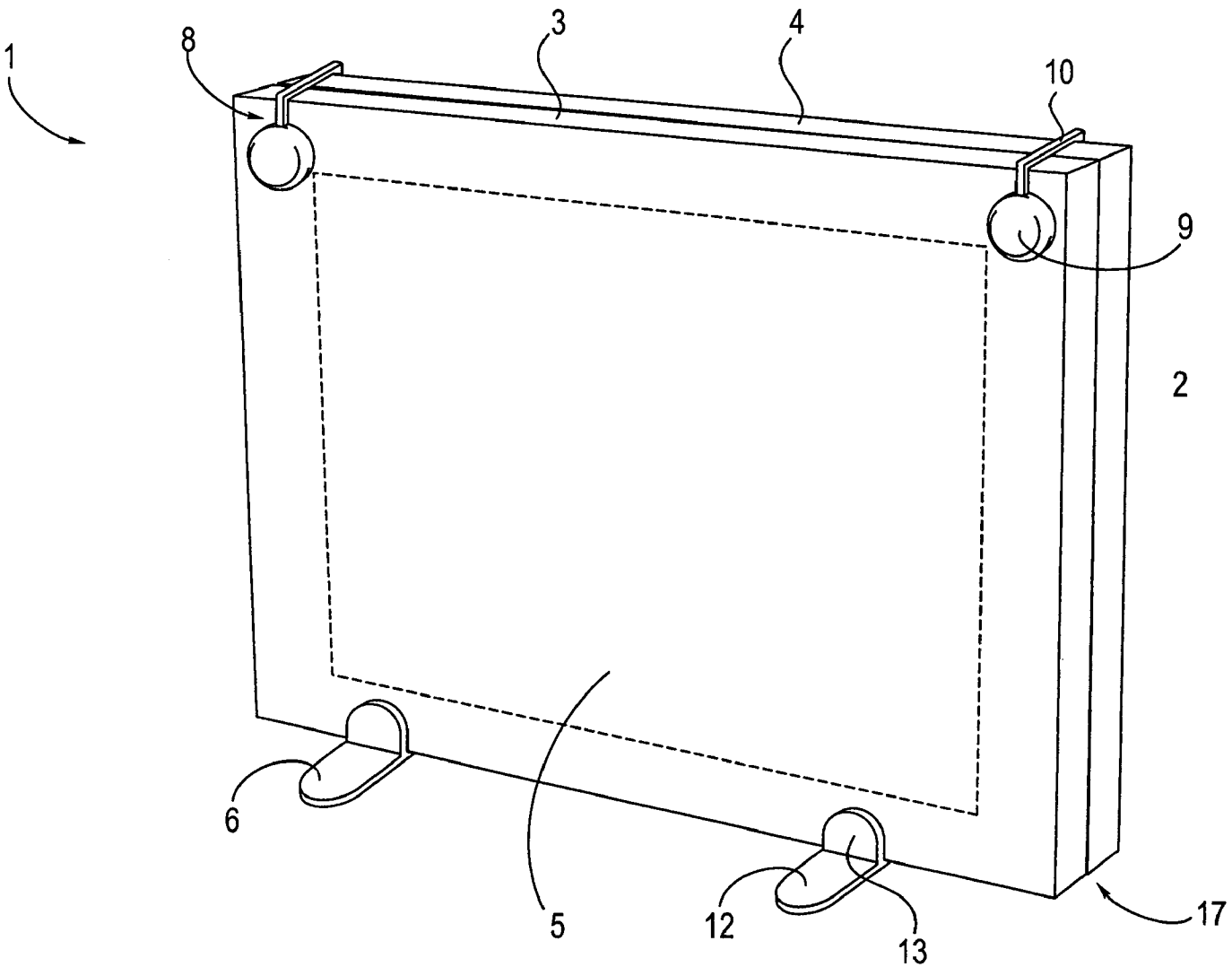
FIG. 1A is a perspective view of a display unit of the present invention having a single overlay section set.

Referring to FIG. 1A, a single overlay section set 17 is shown as a complete display unit 1. The overlay sections of the overlay section set 17 are separate solid material sections which include an art section 5. The art section 5 may be disposed between a transparent section 3 and a backing section 4.

The transparent section 3 may be glass, Plexi-glass, or other transparent material. The backing section 4 may also be transparent. However, this is not required. Where the backing section 4 is transparent, the art section 5 may include a first art piece (not shown) facing the transparent section 3 and a second art piece (not shown) facing the backing section 4. The art section 5 may include a photograph, clipping, momento, or other piece of art having a size and shape cooperating with that of the transparent section 3 and the backing section 4, if present. The cooperating size and shape of the art section 5 promote its secure positioning between the transparent section 3 and the backing section 4.

Continuing with reference to FIG. 1A, clips 8 are shown. The clips 8 help secure overlay sections together as an overlay section set 17 when the art section 5 is secured to a transparent section 3 or a backing section 4. The clips 8 include a main body 9 and a pressure tab 10 which may be individually constructed or uniformly molded as a single piece. The transparent section 3 and the backing section 4 may be equipped with a recess or locking mechanism 80 (see FIG. 3B) to help secure the clips 8 where contact is made with the clips 8.

Securing platforms 6 are also shown in FIG. 1A. As with the clips 8, the securing platforms 6 may help secure the art section 5 to any transparent section 3 or backing section 4 which is included in an overlay section set 17. The securing platforms 6, include base extensions 12 and vertical extensions 13. The base extensions 12 are found forward of and rearward (not shown) of the overlay section set 17. Base extensions 12 are capable of supporting an overlay section set 17, or even a complete display unit 1, on a cooperating surface (see also FIG. 2A). As with the base extensions 12, the vertical extensions 13 are also found forward of and rearward (not shown) of the overlay section set 17. Again, for added security, a recess or locking mechanism 80 (see FIG. 3B) may be provided on the transparent section 3 or the backing section 4 where contact is made with the securing platforms 6.

Figure 1C:
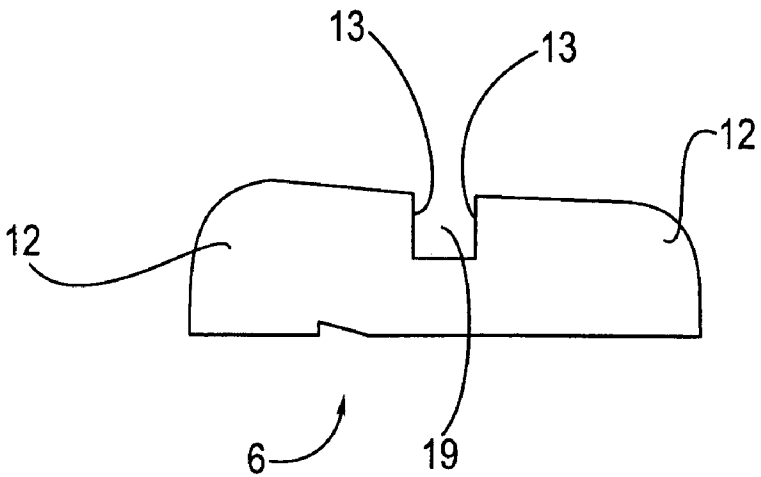
FIG. 1C is a side view of a securing platform of the present invention.
Figure 1B:
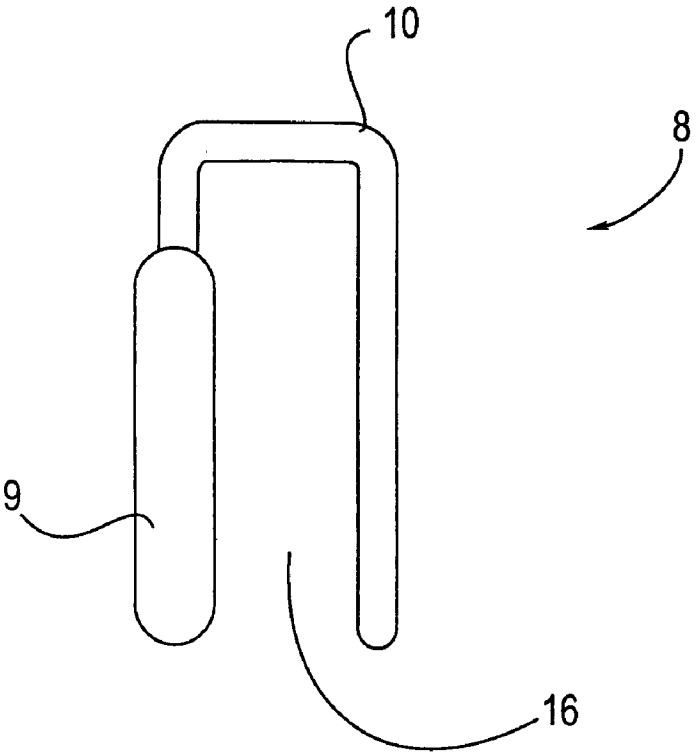
FIG. 1B is a side view of a clip of the present invention.

Referring to FIG. 1B, a clip 8 is shown from the side. Unlike the clip 8 of FIG. 1A, the clip of FIG. 1B is shown as uniformly molded. The clip 8 may be constructed from any combination of commercially available plastics, metals, metal alloys, stone, wood, plaster, castings, and other suitable materials.

A clip notch 15 is shown in FIG. 1B between a main body 9 and a pressure tab 10. The clip notch 15 accommodates a complete overlay section set 17.

The pressure tab 10 may incorporate a tension spring (not shown) or other item capable of enhancing the pressure between an overlay section set 17 and the clip 8. Enhancing this pressure will increase the overall stability of the display unit 1. Additionally, the pressure tab 10, or other clip 8 portion, may be configured to aid in the mounting or hanging of the display unit 1.

In order to accommodate varying user tastes, the main body 9 may be designed in various artful forms. For example, the main body 9 may be shaped as a miniature hand, foot or animal. The main body 9 may be shaped as a letter, a number, or even an astrology sign. Other shapes may include stars, flowers, diamonds, moons, sporting equipment, cartoon characters, and a host of others.

Referring to FIG. 1C, a side view of a securing platform 6 is shown. The securing platform 6 includes rearward and forward base extensions 12. The securing platform 6 of FIG. 1C also includes rearward and forward vertical extensions 13 with a platform notch 19 there between.

The platform notch 19 is capable of accommodating and supporting an overlay section set 17 in conjunction with the surrounding vertical extensions 13 (see FIG. 1A). As with the clip 8, the securing platform 6 may be artfully shaped to accommodate varying user tastes. The securing platform 6 of FIG. 1C exhibits the shape of a shoe, but various other shapes may be used. Additionally, the securing platform 6 may be constructed from materials similar to those used in construction of a clip 8.

Figure 2B:
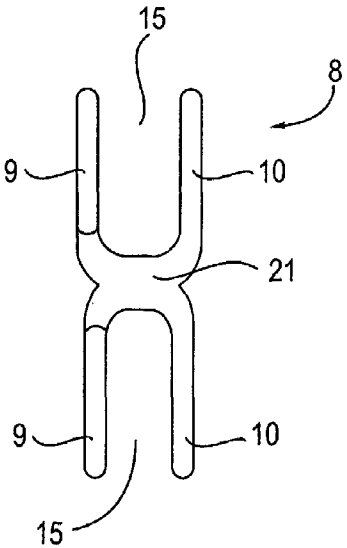
FIG. 2B is a side view of a double clip of the present invention.
Figure 2A:
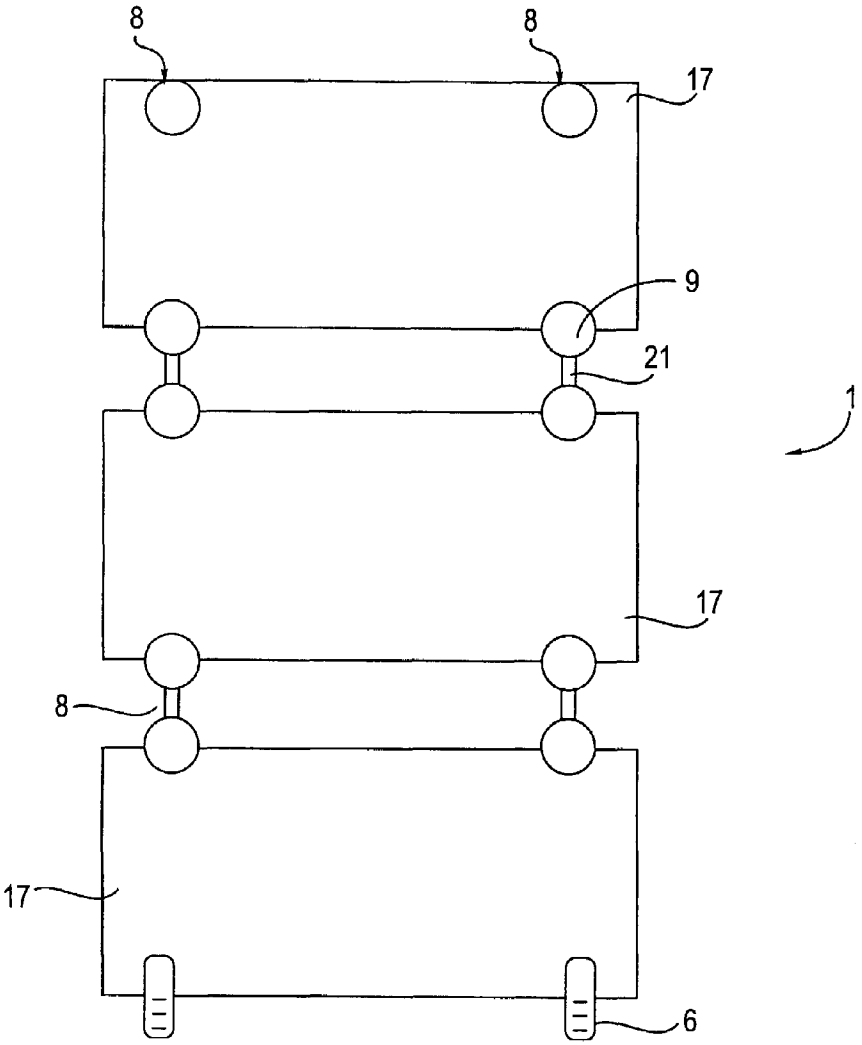
FIG. 2A is a front view of a display unit of the present invention having multiple overlay section sets arranged vertically.

Referring to FIG. 2A, a display unit 1 is shown having several overlay section sets 17. The display unit 1 is supported by a pair of securing platforms 6 below a lowermost overlay section set 17. The top of the uppermost overlay section set 17 is secured by clips 8 similar to those of FIG. 1A.

Separate overlay section sets 17 are secured to one another by double clips 8. The double clips 8 include a first pressure tab (not shown) and a first main body 9 coupled to a second main body 9 and a second pressure tab (not shown) by a hub 21.

The display unit 1 of FIG. 2A has overlay section sets 17 which are aligned vertically. However, there is no requirement that this be the chosen alignment. In some cases a triple (or higher multiple) clip 8 may be used to align overlay section sets 17 vertically and horzontally simultaneously. For example, a four pronged clip could aid in supporting four overlay section sets simultaneously. However, for purposes of explanation, focus has been drawn to a double clip 8.

Referring to FIG. 2B, a side view of a double clip 8 is shown. The double clip 8 includes upper and lower main bodies 9 and pressure tabs 10. A hub 21 is found between the upper and lower portions of the clip 8. Upper and lower clip notches 15 are shown, each capable of helping to secure a separate overlay section set (not shown).

Figure 3A:
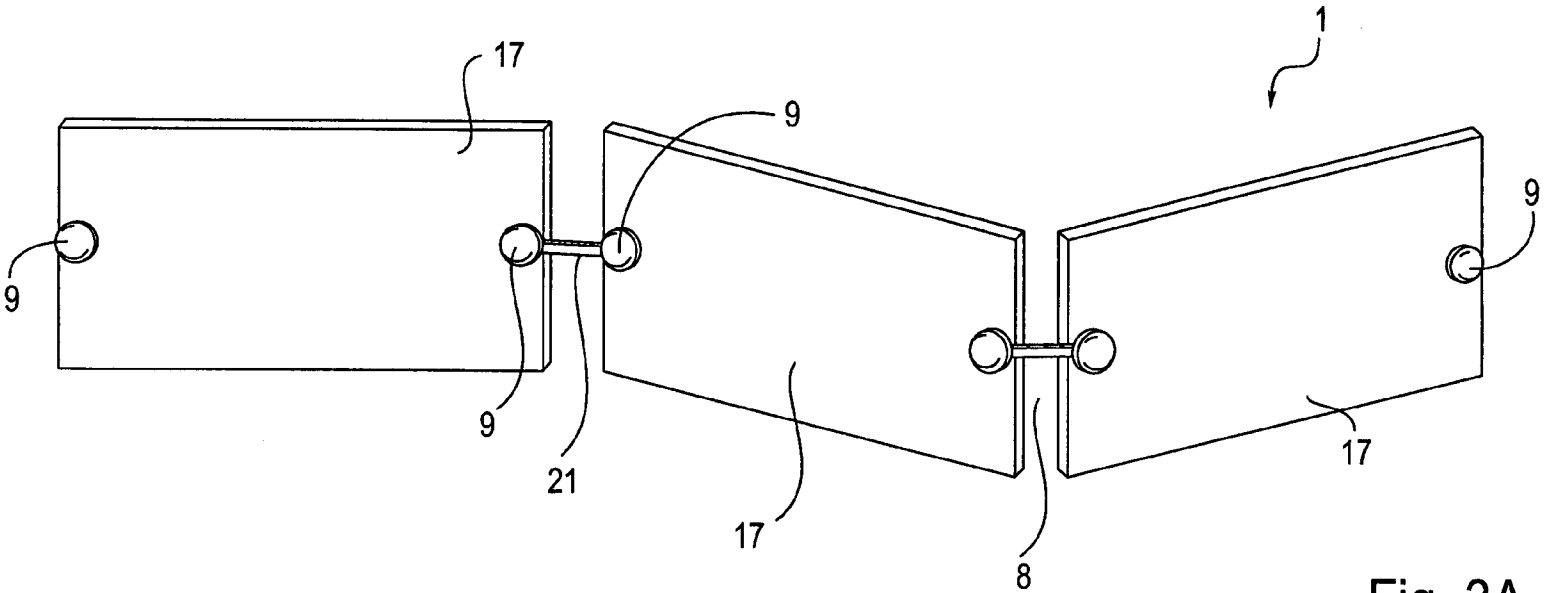
FIG. 3A is a perspective view of a display unit of the present invention having multiple overlay section sets arranged horizontally, and self-supporting.

Referring to FIG. 3A, a display unit 1 is again shown having several overlay section sets 17. Again, separate overlay section sets 17 are secured to one another by double clips 8. However, unlike the embodiment of FIG. 2A, the overlay section sets 17 have been aligned horizontally. Additionally, no securing platforms 6 have been used to position the display unit 1 upright (see also FIG. 2A). Rather, the double clips 8 are hinged, allowing an acute angle to be formed between adjacent overlay section sets 17.

Figure 3B:
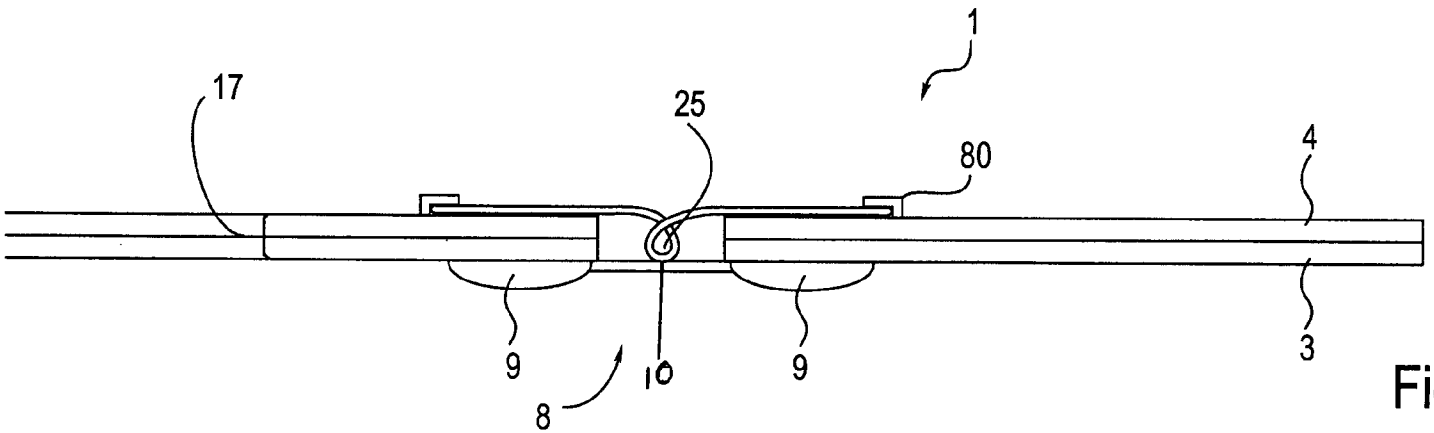
FIG. 3B is a top view of a hinged double clip of the present invention.

Referring to FIG. 3B, a top view of horizontally adjacent overlay section sets 17 of a display unit 1 is shown. From this angle, the transparent section 3 and the backing section 4 are distinguishable. A hinged clip 8 is shown between adjacent overlay section sets 17. The hinged clip 8 is shown having a hinge 25 in place of a solid or alternate form of hub 21 (see also FIG. 2B). The adjacent overlay section sets 17 may now be angled with respect to one another and thus, self supporting.

Although an exemplary embodiment of the invention has been shown and described with reference to particular display units 1, many changes, modifications, and substitutions may be made by one having ordinary skill in the art without necessarily departing from the spirit and scope of this invention. For example, the present invention would be applicable to display units 1 utilizing horizontal and vertical alignments of overlay section sets simultaneously.

A method and apparatus for displaying works of art is disclosed. Although the present invention has been described with respect to specific examples and subsystems, it will be apparent to those of ordinary skill in the art that the invention is not limited to these specific examples or subsystems but extends to other embodiments as well. The present invention includes all of these other embodiments as specified in the claims that follow.

I claim:

1. A frameless system for displaying photographs or other viewable material, comprising:

at least two picture display panels, wherein each picture display panel has a front overlay section and a back overlay section, wherein at least one of the overlay sections is transparent;

at least one double clip including a first clip, a second clip, and a hinge therebetween, wherein each clip defines a notch sized and shaped to hold together the front and back overlay sections at an edge of one of the picture display panels with a picture therebetween and without a frame at the edge, and wherein, each clip has a width covering only a portion of the edge; and a single clip defining a notch sized and shaped to hold together the front and back overlay sections, wherein the single clip is positioned on an edge of one of the at least two picture display panels opposite the double clip wherein one single clip is positioned on a top edge of one of the at least two picture display panels and one single clip is positioned on a bottom edge of one of the at least two picture display panels.

2. The system of claim 1, wherein the double clip rotates about a hinge axis parallel to notch axes of both the first and second clips.

3. The system of claim 1, further comprising at least a third picture display panel and at least a second double clip, the second double clip including a first clip and a second clip.

4. The system of claim 3, wherein the second double clip comprises a hinge between its first and second clips.

5. The system of claim 3, wherein the third picture display panel is attached horizontally.

6. The system of claim 1, wherein the at least one double clip is configured for hingedly connecting the edges between the at least two picture display panels.

7. The system of claim 1, further comprising at least one securing platform to support the picture display panel in an upright position.

8. The system of claim 7, wherein the at least one securing platform comprises:

two base extensions; and a groove defined between the base extensions, the groove sized and shaped to hold together the front and back overlay sections at an edge of one of the picture display panels with a picture therebetween and without a frame.

9. The system of claim 1, wherein the transparent overlay section includes a recess sized to receive one of the clips.

10. A frameless system for displaying photographs or other viewable material, comprising:

at least two picture display panels, wherein each picture display panel has a front overlay section and a back overlay section, wherein at least one of the overlay sections is transparent;

at least one double clip including a first clip, a second clip, and a hinge therebetween, wherein each clip defines a notch sized and shaped to hold together the front and back overlay sections at an edge of one of the picture display panels with a picture therebetween and without a frame at the edge, and wherein, each clip has a width covering only a portion of the edge;

a single clip defining a notch sized and shaped to hold together the front and back overlay sections, wherein the single clip is positioned on an edge of one of the at least two picture display panels opposite the double clip; and an additional single clip, wherein the additional single clip is positioned on the opposite edge of the other of the at least two picture display panels.

11. The system of claim 10, wherein each of the front and back overlay sections is transparent to allow for viewing of more than one picture in a single display panel.

12. The system of claim 10, comprising more than three picture display panels.

13. The system of claim 10, further comprising at least a second double clip, said second double clip including a first clip and a second clip having openings in fixed relation to one another.

14. The system of claim 10, wherein the back overlay section includes a recess sized to receive one of the clips.

* * * * *